US005332882A

United States Patent [19]

Gabalda et al.

[11] Patent Number: 5,332,882

[45] Date of Patent: Jul. 26, 1994

[54] DEVICE FOR HEATING A YARN IN MOTION WITH REMOVABLE HEATER BLOCK

[75] Inventors: Carlos M. Gabalda, Granges les Valence; Pierre Mirabel, Roanne, both of France

[73] Assignee: ICBT Roanne, France

[21] Appl. No.: 83,347

[22] Filed: Jun. 28, 1993

[30] Foreign Application Priority Data

Jul. 8, 1992 [FR] France ..... 92 08691

[51] Int. Cl.[5] ..... F27D 11/02; F27B 9/06; F27B 9/28; D02J 13/00

[52] U.S. Cl. ..... 219/388; 34/273; 219/536

[58] Field of Search ..... 219/388, 536; 34/41

[56] References Cited

U.S. PATENT DOCUMENTS

| | | | |
|---|---|---|---|
| 2,688,067 | 8/1954 | Sonnino et al. | 219/388 |
| 2,896,060 | 7/1959 | Serfass et al. | 34/41 |
| 3,143,764 | 8/1964 | Wildegger . | |
| 3,559,965 | 7/1969 | Ishida . | |
| 4,218,831 | 8/1980 | Harris et al. | 34/41 |
| 4,565,524 | 1/1986 | Runkel et al. | 432/59 |
| 5,193,293 | 3/1993 | Gabalda et al. . | |

FOREIGN PATENT DOCUMENTS

| | | |
|---|---|---|
| 1937492 | 7/1969 | Fed. Rep. of Germany . |
| 2619128 | 8/1987 | France . |
| 524111 | 5/1992 | France . |

*Primary Examiner*—Bruce A. Reynolds
*Assistant Examiner*—John A. Jeffery
*Attorney, Agent, or Firm*—Harris Beach & Wilcox

[57] ABSTRACT

Device for heating a yarn in motion, of the type consisting of an insulating enclosure (15) which surrounds a heater block (E) with which it defines a lengthwise channel inside which the yarn (5) to be treated runs, means for guiding said yarn being provided to ensure its positioning, said heater block (E) consisting of a unit comprising at least two cylindrical sections (A, B) which have different diameters and are arranged one extending the other and which support, over their length, rings (1, 3, 4) equipped with guiding members making it possible to keep the yarn at a constant distance from the surface of small diameter, and making it possible to make the yarn describe a tangent helically with the cylindrical surface of large diameter.

It is characterized in that one of the outermost faces (31) of the cowling surrounding the insulating enclosure and the heater block is removable and carries all the connections which make it possible to provide the electrical supply to the oven, its control etc., the heater block (E) being fastened by one of its ends to said removable face (31).

1 Claim, 2 Drawing Sheets

DEVICE FOR HEATING A YARN IN MOTION WITH REMOVABLE HEATER BLOCK

BACKGROUND OF THE INVENTION

The invention relates to a device for heating a yarn in motion, especially a synthetic yarn while being textured by false twisting.

In the description which follows, the conventional expression of "oven" will be employed to denote such a device which, of course, can be employed equally well for treating continuous, mono- or multifilamentary yarns and spun fibers.

Furthermore, the invention will be described as applied more particularly to texturing by false twisting, but it is obvious that this is not limiting and that it can also find applications in other fields, and in general in all cases where it is desired to heat-treat, with precision, yarns traveling at a high speed.

The invention relates more particularly to an improvement made to the ovens described in European Patent Application published under No. 524,111 (patent which corresponds to U.S. Pat. No. 5,193,293).

In the abovementioned European patent application the Applicant Company has described, as follows from the attached FIG. 1 which is a reproduction of FIG. 7 of that document, a new type of oven capable of being employed especially during a drawing-texturing operation, and which consists of an insulating enclosure which surrounds a heater block with which it defines an outwardly open lengthwise channel, inside which the yarn to be treated runs, means for guiding said yarn being provided to ensure its positioning inside said channel.

The embodiment illustrated in FIG. 1 enables two yarns (5) to be treated simultaneously in parallel. The heater block consists of a unit which comprises at least two cylindrical sections (A, B) which have different diameters and are arranged one extending the other, guiding means (rings 1, 3, 4) for the yarns being provided along the heater block so that they are kept at a constant distance from the surface of the cylinder (A) of small diameter, so that its temperature rise is obtained in this region by radiation and so that it comes into contact with the surface of the zone (B) of large diameter, the transmission of heating being then produced by contact or conduction.

When compared with the conventional ovens in which the heating of said yarn in motion is obtained by means of a heating liquid which, on evaporating, transmits its heat to a body with which the yarn is directly in contact (see especially French Patent 2,619,128), such a solution makes it possible to produce units of particularly simple design permitting the production of heat exchanges which are adapted as a function of the treatments, for example having a slow and uniform rise in bringing the yarn up to temperature, followed by a greater thermal shock, or combining such stages in a different manner; it also permits very high yarn running speeds inside the oven, the heat exchange being produced very uniformly, the risks of vibrations (and therefore of nonuniformity in the treatment) being practically completely eliminated and the placing of the yarn inside the oven being made easier.

Now there has been found—and this is what forms the subject of the present invention—an improvement made to the design of such ovens which makes them easier to maintain (cleaning, changing elements) and which also makes it possible to carry out rapidly and without any difficulty the replacement of a given heating element with another which is adapted as a function of the treatment to be carried out, thus making it possible, if desired, to adapt a machine as a function of the various types of yarns to be treated, given that it is well known that the heat treatment conditions may vary as a function of the nature of said yarns.

BRIEF SUMMARY OF THE INVENTION

In general, the device for heating a yarn according to the invention is of the type consisting of an insulating enclosure which surrounds a heater block with which it defines a lengthwise channel inside which the yarn to be treated runs, means for guiding said yarn being provided to ensure its positioning, said heater block consisting of a unit comprising at least two cylindrical sections which have different diameters and are arranged one extending the other and which support, over their length, rings equipped with guiding members making it possible to keep the yarn at a constant distance from the surface of small diameter, and making it possible to make the yarn describe a tangent helically with the cylindrical surface of large diameter, and it is characterized in that one of the outermost faces of the cowling surrounding the insulating enclosure and the heater block is removable and carries all the connections which make it possible to provide the electrical supply to the oven, its control etc., the heater block being fastened by one of its ends to said removable face.

By virtue of such a design an oven is obtained in which the active element (heater block) can be easily dismantled and refitted either to perform maintenance (cleaning) operations or optionally to replace a heater block of a specified structure with a different block when it is desired to modify the heat treatment, for example when a yarn of different kind is to be treated.

However, the invention and the advantages which it provides will be better understood by virtue of the example of embodiment which follows and which is illustrated by the attached diagrams in which:

DETAILED DESCRIPTION OF THE INVENTION

Figure 1:
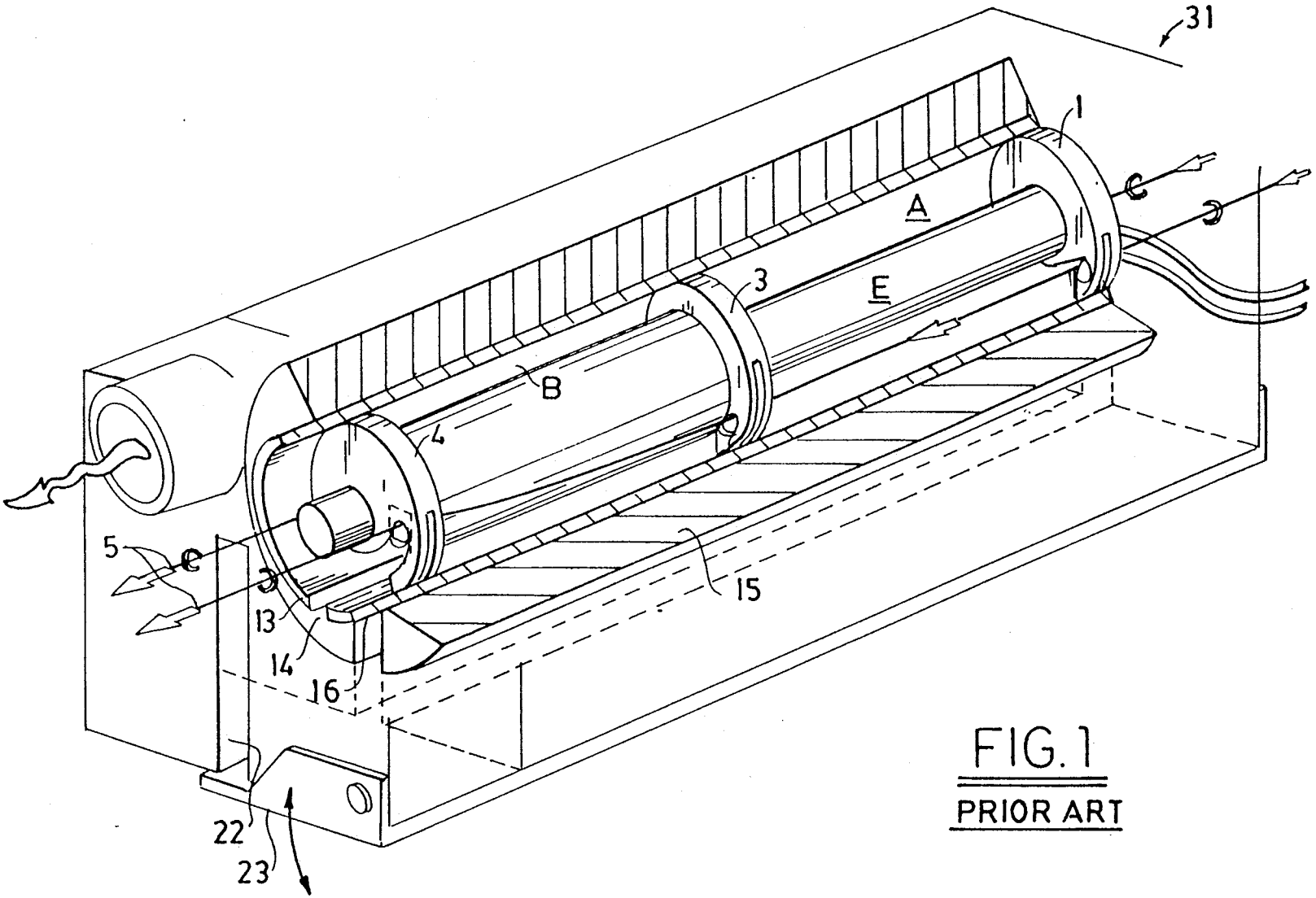
FIG. 1 PRIOR ART
FIG. 1 illustrates, as previously stated, the general structure of a heater element of an oven produced in accordance with the teachings of European Patent application 524,111, corresponding to U.S. Pat. No. 5,193,293.
Figure 2:
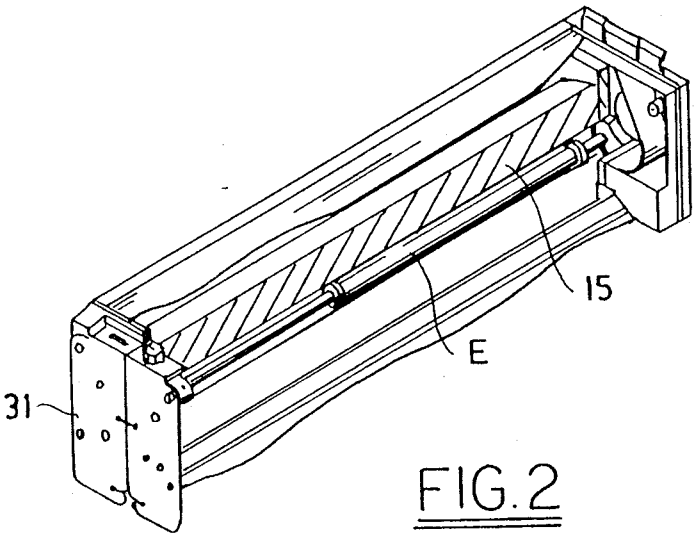
FIGS. 2 and 3 illustrate diagrammatically, in exploded perspective view, an improved oven in accordance with the invention, on the one hand in operating position (FIG. 2) and, on the other hand, (FIG. 3), when the heater element is withdrawn from inside the casing attached to the treatment machine (for example a texturing machine).
Figure 3:
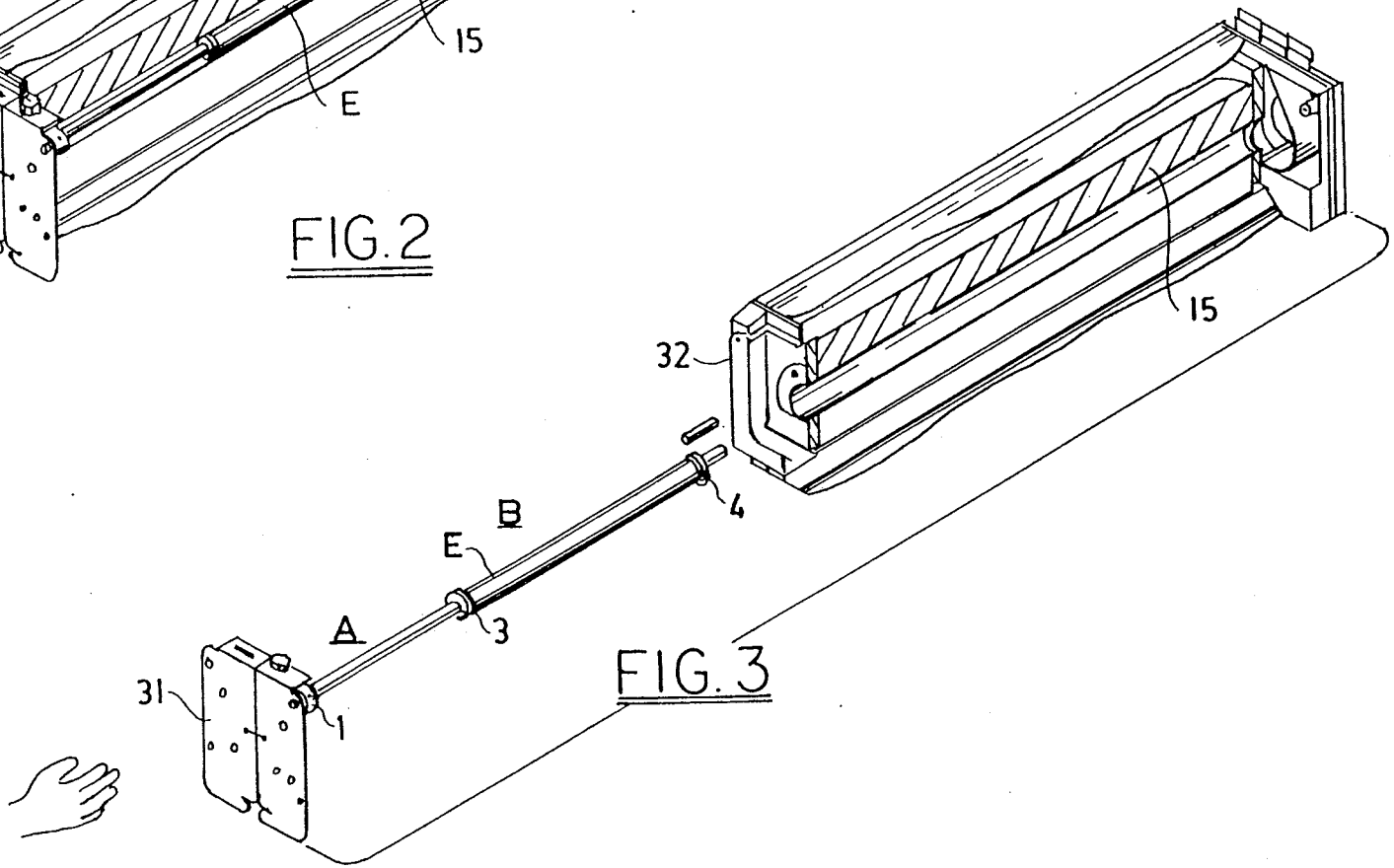

If reference is made to the attached diagrams, and repeating the same references as those employed in the abovementioned European Patent, the oven in accordance with the invention is of the type comprising an insulating block (15), made of refractory material, of cylindrical shape and comprising an internal channel, also cylindrical, intended to receive a heater element, denoted by the general reference (E), also of cylindrical general shape, and comprising, in the embodiment illustrated, two zones (A) and (B) of different diameter.

In the example illustrated the zones (A) and (B) have identical lengths but they can equally have different lengths. By way of guidance, a heater element which has a length of sixty (60) centimeters and comprising two equal zones (A, B), each of thirty (30) centimeters, is particularly suited for producing a machine for texturing by false twisting. The difference in the diameter of the two zones (A) and (B) is generally of the order of a few millimeters. In the case of a texturing machine oven a difference in diameter of the order of eight to ten millimeters is suitable for most textile materials. Such a block can be made as a single component, for example by molding and/or machining a ceramic or a stainless steel, preferably surface-treated so as to increase its hardness (for example plasma treatment and the like). A resistance heater is embedded inside the block thus produced, preferably comprising an incorporated thermocouple component which makes it possible to achieve a precise temperature control.

Around the heater element (E) thus produced are fitted ring-shaped guiding members (1, 3, 4) comprising V- or U-shaped grooves provided with eyelets made of ceramic or of a material marketed under the name "Tital", which, on the one hand, make it possible to guide the yarn (5) (in the present case two yarns (5) are treated in parallel), so as to keep it at a distance from the heating surface of the zone (A) and, on the other hand, to keep said yarn (5) in contact with the surface of the cylinder of the zone (B), thus making it possible to have a combination of heating by radiation and of heating by contact or conduction. The heater block (E) thus produced is arranged inside the internal duct of the insulating block (15), which comprises a liner (13) or shutter flap, comprising a lengthwise slit (14) which makes it possible, when starting up, to place the yarn in position easily when said slit (14) coincides with the slit (16) in the insulating block.

The heating block (E) and insulating material (15) unit is surrounded by a cowling, for example of sheet metal.

In accordance with the invention, one of the faces (face (31) in the present case), by which the yarn enters inside the oven is produced so that it can be removable, all the connections which make it possible to provide the electrical supply to the oven and its construction being fitted on said face (31) and the heater block (E) being also attached by its end to this removable face (31).

By virtue of such a structure it is therefore possible to dismantle and refit the heater block (1) quickly either to perform a maintenance operation or optionally to replace it. Such a possibility is simply obtained by adding to the end of the oven a fastening block (32) to which the removable face (31) is fastened.

Such a design makes it possible to carry out either a self-cleaning of the oven by heating it to a high temperature (for example 600° C.), and this makes it possible, using pyrolysis, to remove the residues which may have been deposited on the heater block, or optionally to carry out such cleaning outside the oven by taking out the heater block.

The invention is obviously not limited to the example of embodiment described above, but it covers all its alternative forms produced in the same spirit.

I claim:

1. In a device for heating a yarn in motion, said device of the type consisting of an insulating enclosure (15) which surrounds a heater block (E) with which it defines a lengthwise channel inside which the yarn (5) to be treated runs, means for guiding said yarn being provided to ensure its positioning, said heater block (E) consisting of a unit comprising at least two cylindrical sections (A, B) which have different diameters and are arranged in cascaded fashion and which support, over their length, rings (1, 3, 4) equipped with guiding members making it possible to keep the yarn at a constant distance from the surface of small diameter, and making it possible to make the yarn describe a tangent helically with the cylindrical surface of large diameter, characterized in that one of the outermost faces (31) of the cowling surrounding the insulating enclosure and the heater block is removable and carries all the connections which make it possible to provide the electrical supply to the oven and its control etc., the heater block (E) being fastened by one of its ends to said removable face (31).

* * * * *